US008794560B2

(12) United States Patent
Salentine et al.

(10) Patent No.: US 8,794,560 B2
(45) **Date of Patent: *Aug. 5, 2014**

(54) RETRACTING TETHER FOR CELL PHONES, PAGERS, AND PDAS

(75) Inventors: John A. Salentine, Goleta, CA (US); Kenneth S. Collin, Jr., Ojai, CA (US)

(73) Assignee: Hammerhead Industries, Inc., Ventura, CA (US)

( * ) Notice: Subject to any disclaimer, the term of this patent is extended or adjusted under 35 U.S.C. 154(b) by 612 days.

This patent is subject to a terminal disclaimer.

(21) Appl. No.: 12/707,525

(22) Filed: Feb. 17, 2010

(65) Prior Publication Data

US 2010/0206976 A1 Aug. 19, 2010

Related U.S. Application Data

(63) Continuation of application No. 10/216,043, filed on Aug. 9, 2002, now Pat. No. 7,665,684.

(60) Provisional application No. 60/311,526, filed on Aug. 10, 2001, provisional application No. 60/388,462, filed on Jun. 13, 2002.

(51) Int. Cl.
*B65H 75/48* (2006.01)

(52) U.S. Cl.
USPC ..... 242/379.2; 242/404.1

(58) Field of Classification Search
CPC ..... A45F 5/00; A45F 5/02; A45F 5/004; A45F 5/021; A45F 2005/026; A45F 2200/0516; A45F 2200/0558; B65H 75/48
USPC ..... 242/378, 379, 379.2, 371, 400, 402, 242/384.7, 381.6, 404.1; 24/3.11, 3.12, 3.6, 24/543, 545
See application file for complete search history.

(56) References Cited

U.S. PATENT DOCUMENTS

| | | | | |
|---|---|---|---|---|
| 1,120,341 | A | 12/1914 | Smith | |
| 1,443,194 | A | 1/1923 | Pichler | |
| 2,775,804 | A * | 1/1957 | Ayoub | 24/3.6 |
| 2,783,926 | A * | 3/1957 | Wise | 224/667 |
| 3,062,478 | A | 11/1962 | Adachi | |
| 3,623,189 | A * | 11/1971 | Wilczynski | 24/3.11 |
| 4,407,460 | A | 10/1983 | Khudaverdian | |
| 4,946,010 | A | 8/1990 | Dibond | 191/12.2 R |
| 4,967,323 | A * | 10/1990 | Johnson et al. | 362/103 |
| 4,969,610 | A | 11/1990 | Taylor et al. | |
| 5,094,396 | A | 3/1992 | Burke | |
| 5,230,117 | A | 7/1993 | Johnson et al. | |
| 5,407,642 | A * | 4/1995 | Lord | 422/122 |
| 5,490,805 | A | 2/1996 | Bredesen | 441/75 |
| 5,507,446 | A | 4/1996 | Ditzig | |

(Continued)

*Primary Examiner* — William A Rivera
(74) *Attorney, Agent, or Firm* — Koppel, Patrick, Heybl & Philpott

(57) ABSTRACT

A retractable tether is disclosed which may be used in conjunction with personal communication devices (such as a Cell Phone, Pager or PDA) mounting system for the prevention of loss or damage. The retracting tether may be clipped to a belt, pants or purse next to the location in which the device is being held or stored. The retractable tether allows the device to be easily used while connected to the retracting tether. Should the device be dropped or dislodged from it's clip mount, holster or storage pocket, the retracting tether prevents the device from hitting the ground thereby preventing loss or damage to the device. A separation mechanism is also incorporated to allow the device to be easily removed from the retractable tether.

14 Claims, 8 Drawing Sheets

(56) References Cited

U.S. PATENT DOCUMENTS

| | | | | |
|---|---|---|---|---|
| 5,697,572 | A | 12/1997 | Salentine et al. | |
| 5,785,221 | A | 7/1998 | Bishop | |
| 5,938,137 | A | 8/1999 | Poulson | |
| 5,954,288 | A * | 9/1999 | Shih | 242/380 |
| 6,073,875 | A | 6/2000 | Paugh | |
| 6,094,566 | A | 7/2000 | Dasent et al. | |
| 6,152,392 | A | 11/2000 | Hawkins | |
| 6,290,158 | B1 | 9/2001 | Huang | |
| 6,318,921 | B1 | 11/2001 | Craine | |
| 6,379,178 | B1 | 4/2002 | Jones et al. | |
| 6,427,374 | B1 | 8/2002 | Vaiani | |
| 6,438,808 | B1 * | 8/2002 | Kung | 24/3.11 |
| 6,467,929 | B2 * | 10/2002 | Lee | 362/191 |
| 6,487,756 | B1 * | 12/2002 | Vidal, Jr. | 24/3.1 |
| 6,502,727 | B1 | 1/2003 | Decoteau | |
| 6,546,103 | B1 | 4/2003 | Wong | |
| 6,634,799 | B2 | 10/2003 | Auld | |
| 6,966,519 | B2 | 11/2005 | Salentine et al. | 242/379 |
| 7,478,776 | B2 | 1/2009 | Salentine et al. | 242/379 |

* cited by examiner

RETRACTING TETHER FOR CELL PHONES, PAGERS, AND PDAS

This application claims the benefit of provisional application No. 60/311,526 to Salentine et al., which was filed on Aug. 10, 2001, and provisional application No. 60/388.462 to Salentine et al., which was filed on Jun. 13, 2002. This application is a continuation in part of application Ser. No. 10/216,043 to Salentine et al., which was filed on Aug. 9, 2002 now U.S. Pat. No. 7,665,684.

BACKGROUND OF THE INVENTION

1. Field of the Invention

The present invention is directed to devices for tethering gear and personal articles and more particularly for tethering personal communication devices such as cell phones, pagers and PDA's.

2. Description of the Related Art

Tethering devices have been developed that have extendable and retractable cables or lines ("cables"), with many of the cables being automatically retracted under the bias of an internal spring arrangement. Some of the applications for these tethers include ski ropes, surf board leashes, boat moorings and scuba equipment. [See U.S. Pat. No. 4,969,610 to Taylor et al., U.S. Pat. No. 4,407,460 to Khudaverdian, U.S. Pat. No. 5,490,805 to Bredesen, and U.S. Pat. No. 5,697,572 to Salentine].

Retracting devices have also been developed for housing cables and cords such as those used for telephones, hose reels and cellular phone earpieces. [See U.S. Pat. No. 5,094,396 to Burke, U.S. Pat. No. 5,507,446 to Ditzig and U.S. Pat. No. 4,946,010 to DiBono]. Retracting devices have also been developed having a means for removing the tethered article from the tethering device such as in the case of keys, SCUBA gear and microphones.

Personal communication devices such as pagers and cell phones can be attached or mounted to a person using different devices. In the case of cell phones some of these mounting devices include leather cases with belt clips for attaching to a belt, or a plastic holster which attaches to a belt or purse. One of the more popular cell phone mounts includes a pivoting ball type mount, which is attached to the phone and clips into a belt clip that has a slot to mate with the ball.

One of the advantages of these holstering devices is that they allow for easy access and retrieval of a cell phone, pager or PDA ("personal device"). However, this advantage also results in one of their primary disadvantages. The ease of access typically prevents these mounting devices from properly securing the personal devices, which can result in their falling out under many circumstances, such as when getting in and out of a vehicle or when they are bumped. Furthermore, when the personal device is removed from these holstering devices there is no mechanism for preventing the phone from falling to the ground if jarred or dropped from the user's hand.

A wrist lanyard has been developed which helps prevent cell phones from falling to the ground when being used. The lanyard typically comprises a rope or string that is tied or otherwise attached to the cell phone and has a loop that is large enough for a user's hand to pass through. To secure the cell phone, the user must pass a hand through the loop when the cell phone is in the user's hand. When the cell phone is not in use, the lanyard can be tied to a belt loop. One disadvantage of this device is that when the phone is tied to a belt loop, untying the lanyard from the loop to use the phone can be awkward and inconvenient. It can also be awkward passing a hand through the loop every time the cell phone is used.

An alternate tethering device uses a spiral or coiled type lanyard, similar to the cord that is used between the receiver and telephone in older styled telephones. For cell phones the coiled lanyard can be attached to the user at one end and attached to the phone at the other. When the phone is in use, the length of the tether can be extended and when the phone is not in use its effective length is reduced. One disadvantage of this type of tether is that to make it long so it can be conveniently used with a cell phone, the tether becomes quite long and obtrusive when the cell phone is in the holstered position. The tether dangles when the phone is not in use, which can cause entanglement.

Existing retractable tethers are used for personal articles such as keys but do not provide a means for attaching to phones or pagers. Furthermore, they are bulky and do not efficiently and securely attach to the user in a way that would allow for the cell phone to be easily used. They also do not provide a means for working in conjunction with a cell phone's holster or mounting system.

SUMMARY OF THE INVENTION

The present invention provides a retracting tether and tethering system which is particularly adapted for use for securing personal devices, including but not limited to cell phones, pagers, PDAs, calculators, flashlights, etc. Personal devices are also referred to as personal articles or objects.

These personal devices have the common characteristic that they can be attached to a user in many locations such as a belt, belt loop or purse. They are often attached by a loop, leather case, or pivoting ball connector type mount or are simply placed in one of the user's pockets. They can easily be knocked to the ground from their mounting points or can be dropped to the ground when in use. The present invention provides a connection point between the user and the personal device that is designed to work with previously available device mounting mechanisms so that if a device is knocked from the mounting mechanism or dropped, it will not fall to the ground where it can be lost or damaged.

A tethering system according to the present invention includes a personal article mounted on a user's body. A retractable tether is included having a housing with a cable and spring within the housing. The cable is capable of extending from and retracting into the tether housing with the spring urging the cable to retract into the housing. The cable has a stop to prevent it from fully retracting into the housing. A mounting mechanism is included for mounting the tether to the user's body and a lanyard is connected between the cable stop and the personal article, with the spring providing sufficient tension to prevent the cable from extending from the housing under the weight of the personal article.

A retractable tether according to the present invention includes a tether housing attached to a base portion by an attachment mechanism. A cable is included within said tether housing, which extends from a hole in the housing. The cable has a stop on its end that extends from the housing hole, which is larger than said housing hole to prevent the cable from fully retracting into said housing. A spring is included within the tether housing which urges retraction of the cable. This spring has sufficient tension to prevent the cable from extending from the housing under the weight of the attached personal article. A flexible lanyard is attached to the stop and arranged to be attached to a personal article. The personal article can be mounted in proximity to the tether housing. A mounting mechanism is included on said tether housing to attach the tether to the user on their belt or other appropriate place.

The retractable tether can either have a fixed mounting mechanism so that the cable extends in one direction from the housing or it can have a rotating and hinging mounting or attachment mechanism that allows the cable to extend at different angles. The tether can also have a disconnect mechanism so that the attached device can be detached from the tether.

The new retractable tethering can be continuously attached to the device whether the personal device is holstered or in use. If the device is dropped or dislodged from the holster the retractable tether prevents the loss of and/or damage to the device. In one embodiment the new retractable tether is mounted to a belt, pants or purse next to the device and the device is in its holster. The tether cable's orientation may be adjusted or adjustable for convenient use, and to reduce wear and tear on the cable to increase its longevity.

The new retractable tether is streamlined and unobtrusive such that it does not interfere with regular activities. The attached device can be easily disconnected from the retracting tether without the removal of the retracting tether from its mount on a belt, pants or purse.

These and other further features and advantages of the invention will be apparent to those in skilled in the art from the following detailed description, taken together with the accompanying drawings, in which:

DETAILED DESCRIPTION OF THE INVENTION

Figure 1:
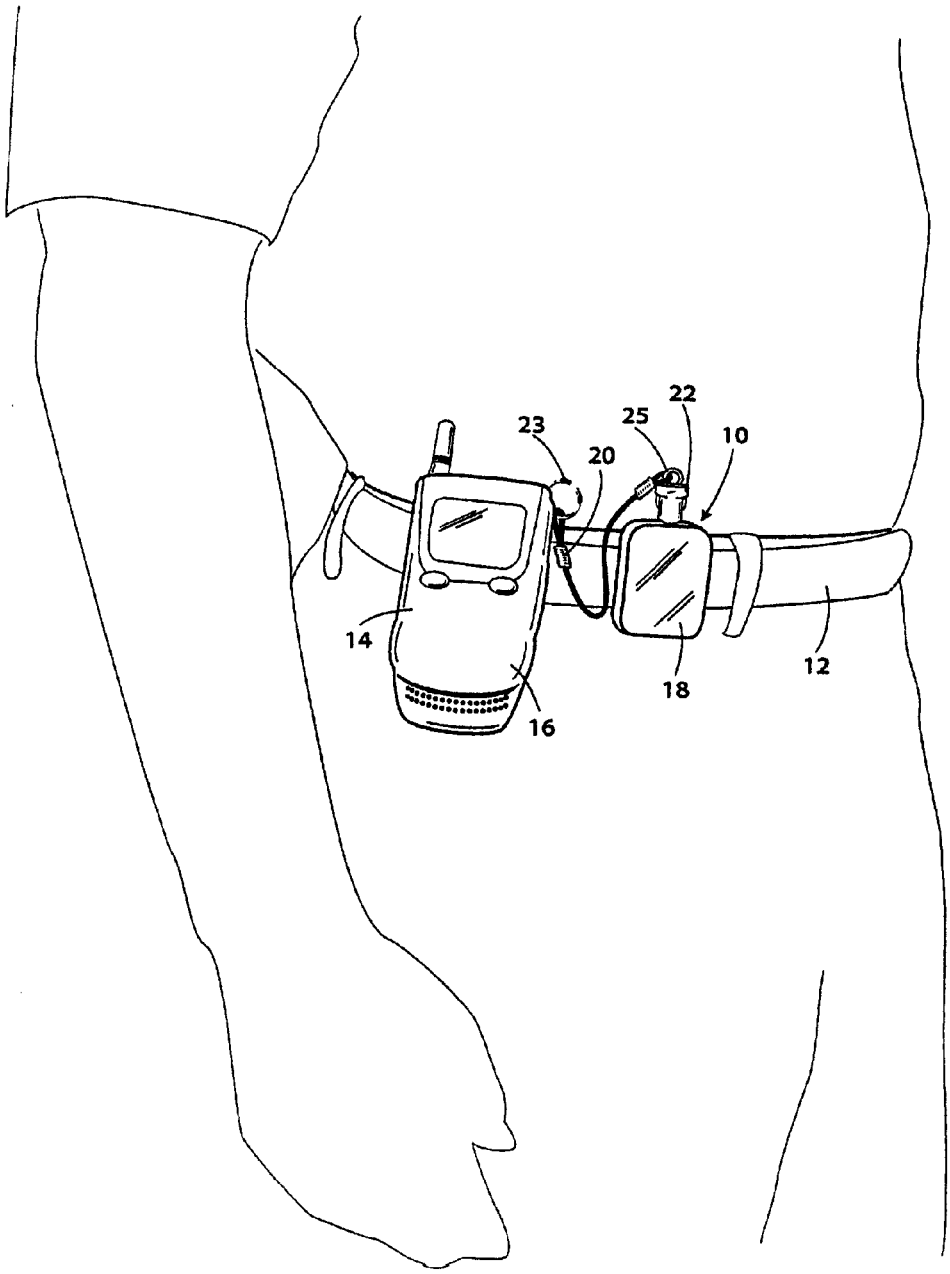
FIG. 1 is a perspective view of one embodiment of a retractable tether according to the present invention attached to a phone that is held in a holster.

FIG. 1 shows one embodiment of a new retractable tether 10 constructed in accordance with the present invention. In the embodiment shown the tether 10 is mounted to a user's belt 12 by its mounting system (described below), but other retractable tethers according to the invention can be mounted to other locations on the user. A phone 14 is shown mounted in its holster 16, which is also mounted to the belt 12 adjacent to the retracting tether 10. The tether 10 can also be used with other devices that are mounted to a user such as pagers, PDAs, Global Positioning Systems, radios, calculators, bull horns, etc.

The retracting tether 10 has a cable that is fully retracted into the retractor tether housing 18. When the phone is in use, the cable extends under a pulling force on the phone. When the force is removed, the cable retracts in to the housing 18 under a bias from an internal spring. The mechanism for extending and retracting the cable from the tether housing 18 is known in the art and involves a coil spring and reel arrangement as described below and as generally described in U.S. Pat. No. 5,697,572 to Salentine and Collin, assigned to the same assignee as the present application.

The tether 10 is relatively thin and has a low profile so it is not bulky or uncomfortable for the user. An attachment lanyard 20 is connected between the tether 10 and the phone 14. As shown, the tether 10 is facing upward with the cable and exiting through the top of the housing 18. This arrangement is particularly convenient for use with phones because it allows the user to pull the phone from the holster up to the ear as the cable extends from the housing 18. By having the tether facing upward the cable can exit straight from the tether housing. This reduces the number of bends experienced by the cable from repeated use, thereby reducing the wear and tear on the cable and extending its life. This arrangement also allows for the cable to be more easily pulled from the housing 18.

Different tethers can be arranged at different angles depending on the type of device attached to the tether 10 and how the device is used. For instance, if a flashlight were attached to a tether 10, the cable could be arranged to extend toward the front of the cable user.

Loops 20*a* and 20*b* are formed at the ends of the lanyard 20 by known methods, with the loops used for connecting the lanyard between the phone 14 and retractable tether 10. A ring 23 is attached to the phone 14 and the loop 20*a* mates with the ring 23 such that the ring 23 passes through the loop 20*a*. At the other end of the lanyard 20 the loop 20*b* mates with a ring 25 in a disconnect mechanism 22, such that the ring 25 passes through the loop 20*b*. The lanyard provides a section of flexible line between phone 14 and the tether 10 so that the phone 14 can be mounted in its holster without cable tension between the phone 14 and tether 10. This allows the phone 14 or other device, to rest in its holstering or mounting system without pulling on the tether cable (shown in FIG. 2). This reduces stress on the tether cable and results in the phone 14 not being pulled from its holster.

The disconnect mechanism 22 allows for the phone 14 to be easily disconnected from the tether 10. Different disconnect mechanisms can be used the mechanism 22 being a clip type. Other disconnect mechanisms can be used including, but not limited to, snaps, screws, ties, or Velcro.

It is understood that when an element such as an element, region or surface is referred to as being "on" another element, it can be directly on the other element or intervening elements may also be present. Furthermore, relative terms such as "inner", "outer", "upper", "above", "lower", "front", "back", "beneath", and "below", and similar terms, may be used herein to describe a relationship of one element to another. It is understood that these terms are intended to encompass different orientations of the device in addition to the orientation depicted in the figures.

Embodiments of the invention are described herein with reference to cross-sectional view illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. Thus, the regions illustrated in the figures are schematic in nature and their shapes are not intended to illustrate the precise shape of a region of a device and are not intended to limit the scope of the invention, unless explicitly stated otherwise.

Figure 2:
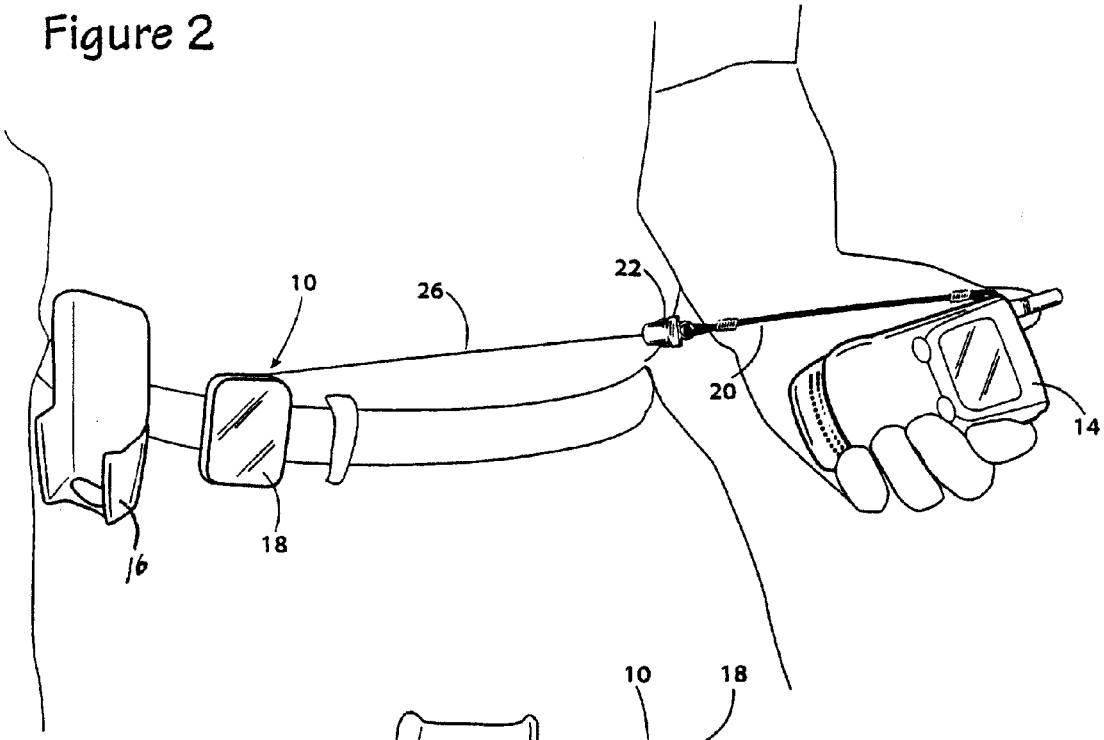
FIG. 2 is a perspective view of the retractable tether in FIG. 1, when the phone is in use.

FIG. 2 shows the phone 14 removed from its holster 16 by the user. The phone 14 is attached to the attachment lanyard 20, and when the phone 14 is removed from its holster 16 and pulled away from the retractable tether housing 18, the tether cable 26 is pulled from inside the tether housing 18. The lanyard 20 is attached to the cable 26 by the disconnect mechanism 22, which also functions as a stop to prevent the cable from retracting completely into the housing 18. The cable 26 exits the tether housing 18 in an upward/outward direction with minimal tension or friction between the cable and the housing 18.

Figure 3:
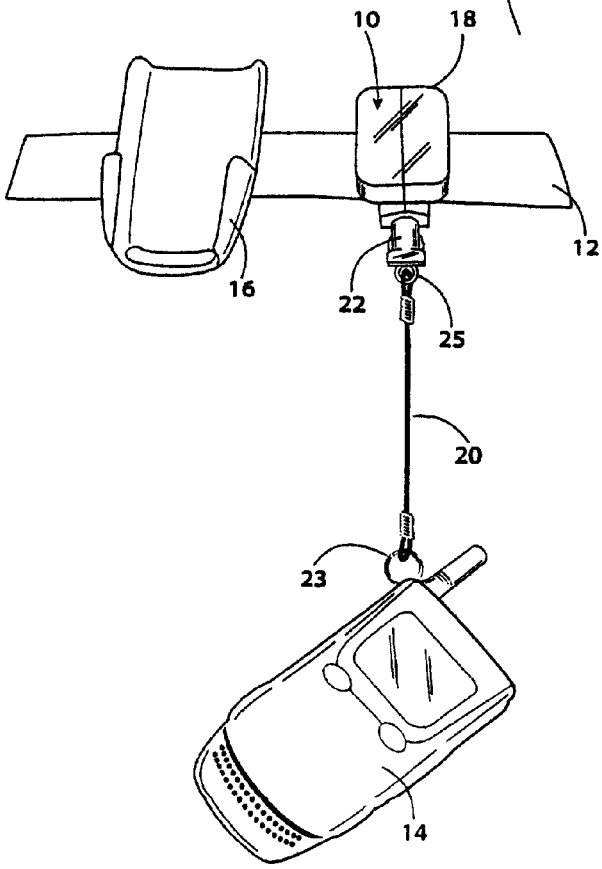
FIG. 3 is a perspective view of the retractable tether in FIG. 1, suspending the phone that has been dislodged from the holder or is dropped.

FIG. 3 shows the phone 14 after it has been dislodged from its holster 16 or after it has been dropped. the tension in the tether's coil spring and the friction between the cable 26 and the tether housing 18 are such that the weight of the phone 14 does not pull the cable 26 from the tether housing 18. The phone 14 is suspended from the tether housing 18 by the lanyard 20 so that the phone 14 does not fall to the ground where it could be lost or damaged.

Figure 4:
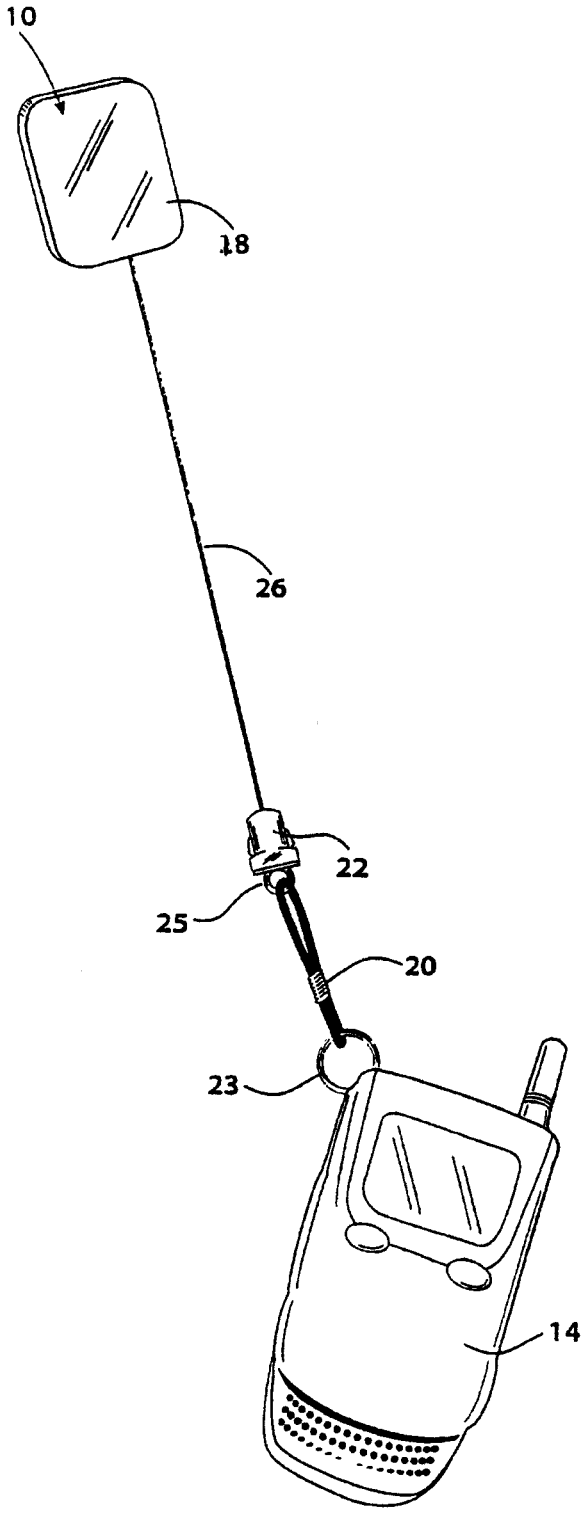
FIG. 4 is a perspective view of the retractable tether in FIG. 1, showing the phones disconnect point with the lanyard.
Figure 5:
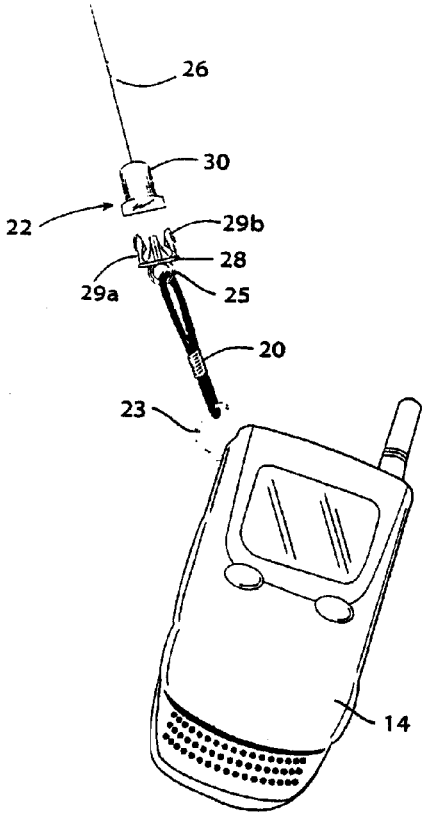
FIG. 5 is a perspective view of the retractable tether in FIG. 4, showing a disconnect point separated.

FIG. 4 shows the phone 14 attached to end 20*a* of the lanyard 20. End 20*b* of the lanyard 20 is connected to the disconnect mechanism 22, and the tether cable 26 is partially extended from the tether housing 18. FIG. 5 shows the same components of the tether 10 connected to a phone 14, as shown in FIG. 4. However, the disconnect mechanism is shown separated into a male clip 28 and a female receiver 30 as would be done to remove the phone 14 from the tether 10. The male clip has two tabs 29*a* and 29*b* that mate with a slot in the receiver 30. To reattach the phone 14, the mail clip 28 is inserted into the receiver 30 and as the clip 28 moves into the receiver 30 the tabs 29*a* and 29*b* are compressed until they pass a receiver lip. The tabs 29*a* and 29*b* then expand out and the clip 28 is held in the receiver 30 by the ledge in the tabs 29*a* and 29*b* butting against the receiver lip. The clip 28 can be removed from the receiver 30 by compressing the tabs 29*a* and 29*b* so they can slide by the receiver lip. When the clip 28 and receiver 30 are separated, the device 14 is disconnected from the retractable tether 10.

Figure 6:
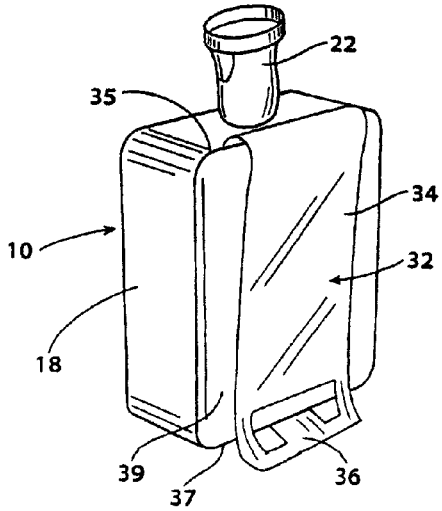
FIG. 6 perspective view of the retractable device in FIG. 1, showing the retractable tether's clip type mounting system.

FIG. 6 shows one attachment mechanism 32 for attaching the tether 10 to a user, with the mechanism 32 being particularly adapted to attaching to a user's belt.

The mechanism 32 comprises a tension blade 34 and a retaining tab 36. To allow for the tether 10 to be mounted with the cable 26 extending up, the tension blade 34 is connected to a first edge 35 of the tether housing 18 adjacent to the disconnect mechanism 22. The blade 34 is directed down toward a second edge 37 of the housing 18 that is opposite the disconnect end 22. The blade 34 is shaped such that it is urged against the housing with the blade's lower portion resting against the back surface 39 of the housing 18. When the tether 10 is mounted to a user's belt, the belt is held between the blade 34 and the housing 18. The blade has a tab 36 at its lower end that is positioned such that overlaps the second edge 37 of the user's belt. The tab 36 extends between the blade 34 and the second edge to provide a stop that prevents the tether from sliding off the user's belt.

Figure 7:
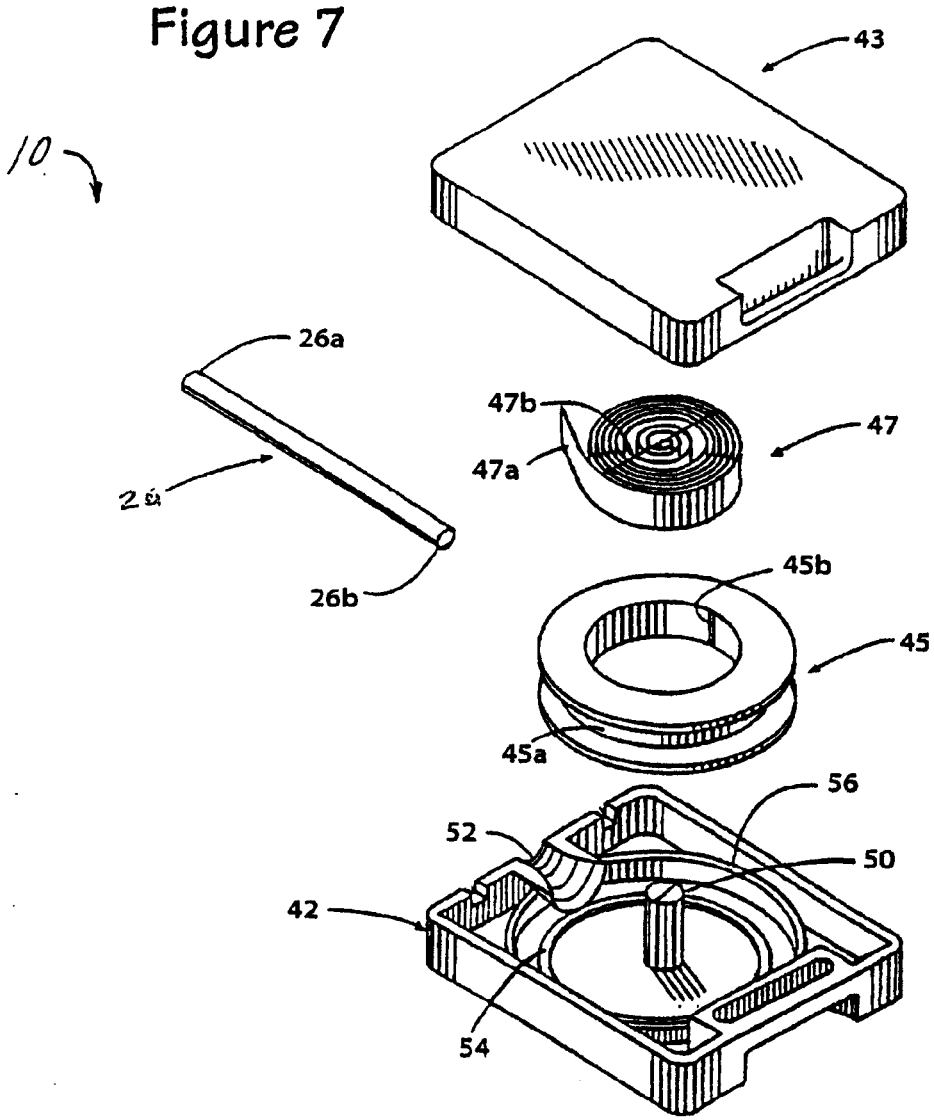
FIG. 7 is an exploded view of the retractable tether shown in FIG. 1.

FIG. 7, shows the internal components of a retractable tether 10 according to the present invention, although many other tethers can be used which can have different internal components. The tether body 18 comprises a clam-shell type housing having a bottom half 42 and a top half 43 which halves matingly engage with each other to enclose an interior space. The cable 26 has a free end 26*a* and a fixed end 26*b*, which is securely fastened to the outer perimeter of a reel 45. The reel 45 is ring shaped and has an annular outer surface 45*a* upon which surface the cable 26 is wound, and an annular inner surface 45*b*. The reel's inner surface 45*b* has a slat, which receives the outer end 47*a* of a coil spring 47. The coil spring 47 has a fixed inner end 47*b* non-releasably mounted in a slot in a central pin 50, which is affixed to the bottom half 42 of the case.

When the upper half 43 and lower half 42 are joined together to form the housing, the pin 50 forms a central axis of rotation for the reel 45 which rolls the cable 26 upon the reel outer surface 45*a*. The upper half 43 of the housing contains hollow pillars (not shown) which support the lower half 42 of the case. The lower half 42 of the case has holes receiving screws for attaching the lower half 42 of the housing to the upper half 43.

Each half of the housing has a semicircular groove 52 therein. When the case is assembled, the semicircular grooves 52 in the respective halves form a circular guide hole having a smooth surface for the cable 26 to slide through.

Each half 42 and 43 has a raised annular bearing surface 54 thereon which supports and stabilizes the reel 45, providing a low-friction close fitting surface for the reel 45 to rotate against permitting low friction rotation of the reel 45. A cavity wall 56 forms a physical barrier around the reel 45 and coil spring 47.

Figure 8:
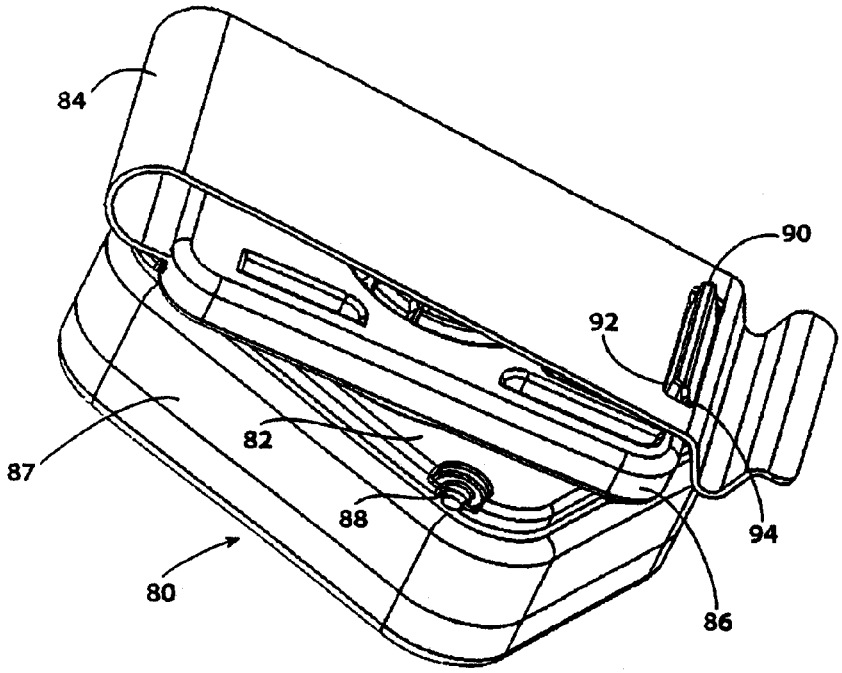
FIG. 8 is a perspective view of a rotating attachment mechanism for a retractable tether according to the present invention.
Figure 9:
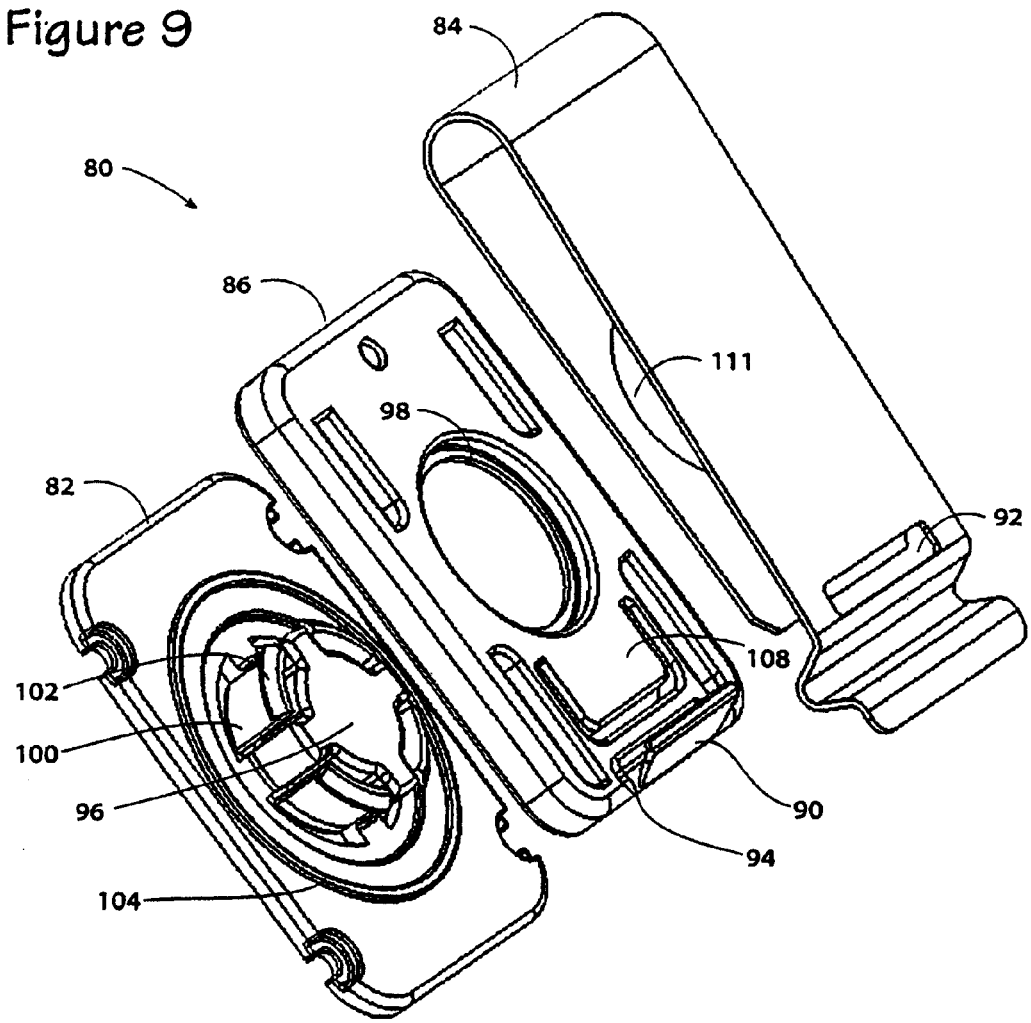
FIG. 9 is an exploded view of the attachment mechanism shown in FIG. 8.

FIGS. 8 and 9 show a second embodiment of an attachment mechanism 80 according to the present invention for attaching the retractable tether 10 to a belt, purse or pocket. This embodiment has the additional feature of allowing the tether 10 to rotate 360 degrees about the attachment mechanism. This type of attachment is particularly adapted for use with cell phones or pagers that may be stored in different locations, such as in a holster on one occasion and in a pocket on another. It also allows for the tether's cable to be extended at different angles to compensate for different body types. For instance, it may be difficult for heavier user's to extend the cable directly up and when the cable is extended directly it can experience additional wear and tear by bending over a user's mid-section. The rotation of the mechanism 80 can make the tether 10 more comfortable and convenient to use while minimizing wear and tear.

The mechanism 80 generally includes a base 82, a belt tension blade 84 and a retaining section 86. The blade 84 is disposed such that half of it is sandwiched between the retaining section 86 and the base 82 and the other half serves to retain the belt between the blade 82 and retaining section 86. The retaining section is rotatably attached to the base 82 and the base 82 is mounted to a retracting tether 87 at mounting holes 88. The belt clip 82 is particularly adapted to fitting over a belt, but can also be mounted to other location such as a purse or pocket. When mounted to a belt, a potion of the belt is held between the blade 84 and the retaining section 86. The retaining section 86 has a retaining tab 90 that mates with a first lower slot 92 in the blade 84. After the belt is disposed between the blade 84 and the retaining section 86, the tab 90 can be inserted into the first slot 92 and the tab 90 can be locked in the first slot 92 by the tab lip 94 overlapping the edge of the slot 92.

To remove the mounting mechanism 80 from the belt, the tab 90 is pushed up toward the bend in the blade 84 until the tab lip disengages from the slot edge. The tab 90 can then pass from the slot 92 to provide an opening through which the belt can pass.

Referring now to FIG. 9, the base 82 has a locking post 96 that is inserted into the retaining section's central hole 98. The post 96 has circumferential tabs 100 that compress as the post 96 is inserted into the hole 98 and expand as the retaining section 86 reaches its operational position. The tab lips 102 hold the post 96 within the hole 98 while allowing the retaining section 86 to rotate around the post 86. The retaining section 86 primarily contacts the base 82 at the circular bearing surface 104 around the post 96. This allows the retaining section 96 to more smoothly rotate around the base 92.

The retaining section 86 also has a planar tab 108 that is arranged to mate with a second slot 110 in the blade 84. When the mechanism is assembled, the retaining section 86 is mounted within the U-shape of the blade 84. The post 96 first passes through the clip hole 111 before passing into the central hole 98. As the pieces of the mounting mechanism are brought together, the planar tab 98 mates with the second slot 100 to hold the blade 84 in proper orientation with the retaining section 86. When the mounting mechanism 80 is assembled, the portion of the clip with hole 111 and slot 110 is held between the retaining section 86 and the base 82.

When a retractable tether 10 with a rotating mounting mechanism 80 is used with a personal article, the tether 10 is free to rotate around the rotating mechanism to that the article can be used or stored at many different angles. The tethering system could still include a lanyard to reduce tension on the tether cable. If the article is dropped or jarred from its mount or holster, the tether will rotate to the article's direction of fall. As a result, the rotating tether would not have the braking that is associated with a tether with a fixed mount in the upward direction. However, to assist in preventing the article from falling to the ground, the rotating tether could have a spring with greater tension or could be used with lighter articles.

Figure 10:
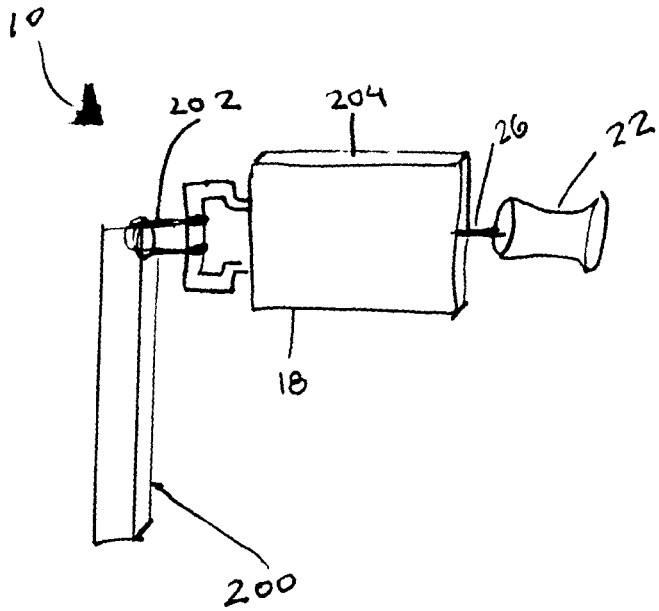
FIG. 10 is a perspective view of one embodiment of a retractable tether according to the present invention.

FIG. 10 shows another embodiment of a new retractable tether 10 constructed in accordance with the present invention. In the embodiment shown the tether 10 is a 2 part device mounted to a user's belt 12 by its mounting system (described above), but other retractable tethers according to the invention can be mounted to other locations on the user. The tether has a back or base portion 200 which mounts to the user's belt. At the top of base portion 200 is a rotating mount or clip 202 which attaches to a front portion of the tether 204. The front portion 204 can not only rotate around the rotating mount or clip 202 but can also flip up or away from the base portion 200 in a hinge-like fashion. The rotating mount or clip 202 and flipping mechanism can be accomplished by many different rotational devices and attachment points known in the art, such as pins or clips. The tether 10 can be used with many devices that are mounted to a user such as pagers, phones, PDAs, Global Positioning Systems, radios, calculators, bull horns, etc.

The retracting tether 10 has a cable that is fully retracted into the retractor tether housing 18, in the front portion 204. When the phone is in use, the cable extends under a pulling force on the phone. When the force is removed, the cable retracts in to the housing 18 under a bias from an internal spring. The mechanism for extending and retracting the cable from the tether housing 18 is known in the art and involves a coil spring and reel arrangement as described below and as generally described in U.S. Pat. No. 5,697,572 to Salentine and Collin, assigned to the same assignee as the present application. When an attached phone is in use the front portion 204 can also be flipped up so that the cable 26 output and disconnect mechanism 22 are oriented in the upward direction where the user would be holding the phone while using it.

Figure 11:
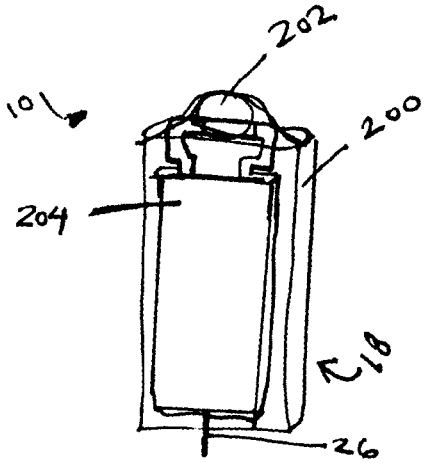
FIG. 11 is another view of the embodiment shown in FIG. 10.

An attachment lanyard 20 can be connected between the tether 10 and a phone or other connected device. As shown in FIG. 11, in the resting position the tether 10 is facing downward with the cable and exiting through the bottom of the housing 18. Since the front portion 204 which is also the tether housing 18 can flip upward and also rotate, this arrangement is particularly convenient for use with phones because it allows the user to pull the phone from the holster up to the ear as the front portion 204 flips up and the cable extends from the housing 18. The user can also hold the phone out in front of them while viewing and using the device as the front portion would rotate to face forward, the direction the phone would be pulled in. By having the tether rotating and flipping the cable can exit straight from the tether housing. This reduces the number of bends experienced by the cable from repeated use, thereby reducing the wear and tear on the cable and extending its life. This arrangement also allows for the cable to be more easily pulled from the housing 18.

Different tethers can be arranged at different resting angles depending on the type of device attached to the tether 10 and how the device is used. For instance, if a flashlight were attached to a tether 10, the cable could extend toward the front of the cable user.

The tether 10 can also include a mechanism, such as a button or a switch, located on the side, front, or other appropriate location, of the tether housing 18 to allow stopping or suspending of the extended tether at a desired length extended out of the tether housing 18. This would allow a user to pull the attached device away from the mounted location and tether 10 a desired distance and then engage the suspension of the cable retraction to give the device slack at the desired length. When the user is done with the device they can disengage the suspension and retract the device. This is helpful in situations where the user will be using the attached device at a certain distance for a prolonged period or wants to place the item at a certain distance without the tension of the retraction mechanism.

Although the present invention has been described in considerable detail with reference to certain preferred configurations thereof, other versions are possible. Therefore, the spirit and scope of the invention should not be limited to the embodiments described above.

We claim:

1. A retractable tether, comprising:

a base portion;

a tether housing attached to said base portion by an attachment mechanism, wherein said attachment mechanism allows for said tether housing to be movable with respect to said base portion in a direction similar to a hinge arrangement;

a cable within said tether housing, said housing having a hole from which said cable extends, said cable having a stop on its end that extends from said housing hole, said stop being larger than said housing hole to prevent said cable from fully retracting into said housing;

a flexible lanyard attached to said stop and arranged to be attached to a personal article, said personal article capable of being mounted in proximity to said tether housing, said flexible lanyard having a length greater than the distance between said mounted personal article and said tether housing such that said cable is not extended from said housing, and said cable is not under tension, by said mounted personal article;

a spring within said tether housing which urges retraction of said cable wherein said spring has sufficient tension to prevent said cable from extending from said housing under the weight of said attached personal article;

a mounting mechanism on said tether housing, said mounting mechanism comprising a tension blade having a first and second end, said first end connected to said tether housing, with the second end opposite said first end and adjacent to said housing, at least part of said blade urged against said housing and arranged so that a belt is capable of being held between said blade and said housing; and a blade tab at said blade's second end that is positioned such that it extends between said blade and said housing and overlaps an edge of said housing to provide a stop to prevent the retractable tether from sliding off a belt after said retractable tether is mounted on the belt.

2. The tether of claim 1, wherein said flexible lanyard has a fixed length.

3. The tether of claim 2, further comprising a separating mechanism to allow for said personal article to be separated from said retracting tether.

4. The tether of claim 2, further comprising a mechanism to allow stopping or suspending of the cable in an extended position at a desired length extended out of the tether housing.

5. The tether of claim 1, wherein said attachment mechanism allows said tether housing to rotate about said attaching mechanism without interfering with said tether housing, said cable being extendible from said tether housing at different angles depending on the orientation of said tether housing.

6. The tether of claim 1, wherein said lanyard comprises a rope or string.

7. The tether of claim 1, wherein said mounting mechanism is arranged to mount said retractable tether to a belt.

8. The tether of claim 1, wherein said personal article is a cell phone or pager mounted to a belt and said retractable tether is mounted adjacent to said personal article on a belt.

9. The tether of claim 8, wherein said retractable tether is mounted adjacent to said personal article within a distance less than the length of said tether so that said cable is not retracted from said housing when said personal article and retractable tether are in their mounted position.

10. The tether of claim 1, wherein said retractable tether is arranged so that when said tether housing is in a resting position said cable extends from said housing in a downward direction and when said tether housing is moved away from said base portion said cable extends from said housing in an upward direction for use of said cell phone or pager without substantially bending said cable.

11. The tether of claim 1, wherein said retractable tether is mounted adjacent to said personal article within a distance less than the length of said lanyard so that said cable is not retracted from said housing when said personal article and retractable tether are in their mounted position.

12. The tether of claim 1, wherein said retractable tether is arranged so that said cable extends without substantially bending said cable.

13. The tether of claim 1, further comprising a separating mechanism to allow for said personal article to be separated from said retracting tether.

14. The tether of claim 1, further comprising a mechanism to allow stopping or suspending of the cable in an extended position at a desired length extended out of the tether housing.

* * * * *